United States Patent [19]

Wright

[11] 4,218,909

[45] Aug. 26, 1980

[54] PLATE BENDER

[76] Inventor: Norman D. Wright, 101 Cardinal Dr., St. Clair, Ill. 62221

[21] Appl. No.: 925,192

[22] Filed: Jul. 17, 1978

[51] Int. Cl.[3] ..... B21D 5/04

[52] U.S. Cl. ..... 72/320

[58] Field of Search ..... 72/319, 320, 321, 322, 72/323, 381, 387, 388, 411, 418, 451, 453.03

[56] References Cited

U.S. PATENT DOCUMENTS

| | | | |
|---|---|---|---|
| 2,175,679 | 10/1939 | Beatty | 72/321 |
| 2,228,448 | 1/1941 | Fader, Jr. | 72/319 |
| 3,301,034 | 1/1967 | Boettcher | 72/319 |
| 3,733,872 | 5/1973 | Gregoire | 72/213 |

FOREIGN PATENT DOCUMENTS

| | | | |
|---|---|---|---|
| 674530 | 11/1963 | Canada | 72/306 |

*Primary Examiner*—Milton S. Mehr
*Attorney, Agent, or Firm*—Lionel L. Lucchesi

[57] ABSTRACT

A bending machine for forming offset printing plates and conversion components for converting older model plate benders into bending machines capable of forming reverse bend plates. The plate bender includes a table support for the plate to be bent. The table is provided with edges having contours identical to the desired contours of the edges of the plate after bending. At least one of the end edges is provided with a die having a reverse bend component formed in it. The bend on one end of the plate may be formed in a conventional manner, while the reverse end bend of the plate is formed in a two-bend sequence by suitable structural components which in themselves may form a conversion system for older plate benders.

5 Claims, 4 Drawing Figures a.

b.

PLATE BENDER

BACKGROUND OF THE INVENTION

This invention relates to printing plates and benders therefor, and in particular, to a bender for manufacturing printing plates where the plates are adapted for self-locking onto the plate cylinder of a press apparatus.

Offset printing presses, for example, employ cylinders having thin, metal plates attached to them. The plates, usually of aluminum or other material or metal alloy, have an image to be printed deposited on them by photographic processes. The plates ordinarily are wrapped around the plate cylinders of the presses when they are in use to effect an imprinting. After bending, the plates are wrapped around the periphery of the plate cylinder of the offset press by attaching a leading edge of the plate to one edge defining a first axial groove in the cylinder and thereafter wrapping the plate around the cylinder until the trailing edge of the plate enters the groove at an opposite second edge defining a second axial groove in the cylinder. Conventionally, two plates are required to cover the periphery of the cylinder. In the past, the plates have been held on the cylinders by "fingers" which engage the end edges of the plates. More recently, the plate bends themselves have been employed to effect attachment. For example, a co-pending application by Signorelli et al, Ser. No. 880,459, filed Feb. 23, 1978, discloses a metal printing plate having a reverse bend formed in it. The reverse bend permits the plate to snap on and lock onto the printing cylinder of the offset device so that the plate is juxtapositioned the cylinder along the entire plate area between the leading edge of the plate and a reverse bend part of the trailing edge of the plate. This construction has enabled considerably thinner plates to be manufactured and used than previously possible. Thinner plates have resulted in a substantial material cost savings. The plate construction itself results in less down time of the offset presses, caused, for example, by rupture of the plate during use.

The invention disclosed hereinafter provides a plate bender for forming the plate described in the above-referenced co-pending application. The plate bender may be manufactured as a independent new construction. In the alternative, the components required for forming the reverse bend may be manufactured and sold as a conversion kit for converting plate benders presently available in the art. For example, one prevalent plate bender for forming printing plates is shown and described in the U.S. patent to Gregoire, U.S. Pat. No. 3,733,872, issued May 22, 1973. General features of plate benders not specifically forming a part of the invention disclosed hereinafter are intended to incorporated by reference to the Gregoire patent.

One of the objects of this invention is to provide a plate bender capable of efficiently forming a reverse bend on at least one end of a printing plate.

Another object of this invention is to provide a low cost plate bender for forming a reverse bend on at least one end of a printing plate.

Another object of this invention is to provide structure for converting prior art benders into devices capable of forming a reverse bend on at least one end of a printing plate.

Other objects of this invention will be apparent to those skilled in the art in light of the following description and accompanying drawings.

SUMMARY OF THE INVENTION

In accordance with this invention, generally stated, a plate bender for a printing plate having a leading edge and a trailing edge is provided with structure for forming a first contour bend along the leading and trailing edges and a second contour bend in a directional sense opposite to the first bend on at least one of the leading and trailing edges. The structure for forming the second contour bend may be incorporated in a plate bender as manufactured, or may be manufactured and sold as a conversion kit for updating plate benders already in service.

DESCRIPTION OF THE PREFERRED EMBODIMENT

Figure 1:
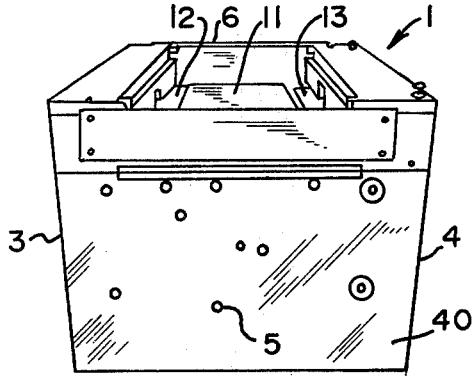
FIG. 1 is a view in perspective of one illustrative embodiment of a prior art plate bender with which the invention disclosed hereinafter finds application.

Referring now to FIG. 1, reference numeral 1 indicates one illustrative embodiment of an offset plate bending machine employing a reverse bend system 2 for forming a printing plate 7.

The plate bending machine or plate bender 1 includes a housing or enclosure 40 having spaced apart end walls 3 and 4, a front 5 and a back 6. The denomination of the sides of enclosure 40 is for convenience of description only. In use, plates to be bent are fed to the bender 1 from the end wall 4 side thereof, for example.

The rectangular plates 7 used in conjunction with offset presses are made of thin metal and are wrapped around cylindrical rolls so that their shape in printing use generally is semi-cylindrical. FIG. 3*a* shows the plate 7 in its unbent condition, while FIG. 3*c* shows the plate 7 in its finished form. The plate 7 generally has a rectangular central portion 8, a leading edge 9 and a trailing edge 10. The notations "leading" and "trailing" edges are used for descriptional purposes only, and either edge of the plate may be so designated prior to having the bending operation described herein performed on the plate. The plates may have various registering or locating openings or holes formed in them and at least one surface, particularly along the central portion 8, has the particular matter for which reproduction is desired deposited on it, generally by a photographic process.

In general, the plate bender 1 includes a support means 11 having a first die 12 and a second die 13 attached to it by any convenient method. Conventional threaded fasteners work well as attachment means, for example. Typically, the support means 11 is adjustably mounted so as to permit extension and retraction of the dies 12 and 13 with respect to one another so as to accommodate a variety of differing plate sizes. The adjustable mounting also permits the easy removal of the plate 7 after plate formation later described.

The support means 11, in the embodiment illustrated, is attached to a drive system 14 along a drive shaft 15 which moves the support means 11 from the position shown in FIG. 3*a* to an upper or raised position shown in FIG. 3*c*. Drive system 14 may comprise a variety of commercially available systems, the most conventional ones of which are hydraulically or electrically operated, for example. In prior art plate benders, upward movement of the support means 11 force the plate 7 against a pair of rollers which roll formed the ends 9 and 10 of the plate into a desired shape. In the plate bender of this invention, one end of the plate 7 still may be formed by the roller device, however, the end 10 of the plate 7 is formed by the reverse bend system 2.

Figure 3:
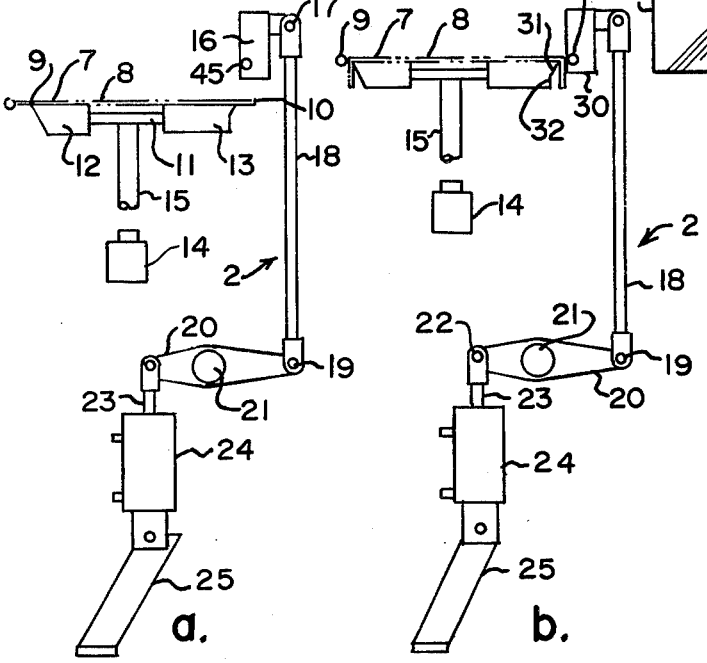
FIGS. 3*a, b* and *c* are a series of views showing the steps required to form a reverse bend on a printing plate, the structure there shown being adapted for use either as original equipment in or as a conversion kit for the type of benders shown in FIG. 1, for example.
Figure 3:
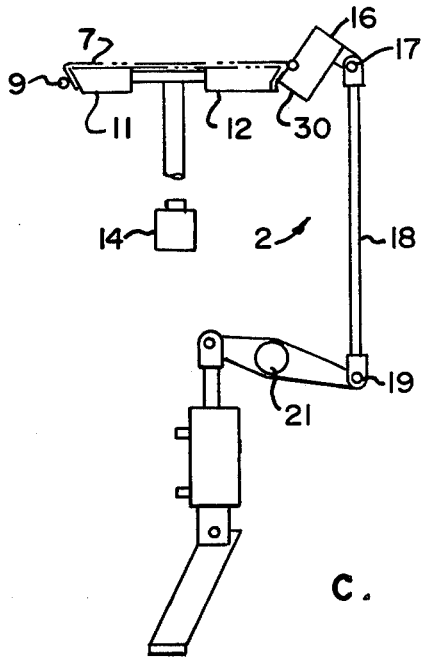

As shown in FIG. 3, the reverse bend system 2 includes a mandrel 16 which is supported at and rotatably mounted about a support rod 45. The rod 45 is operatively attached to the enclosure 40 or some other suitable part thereof at each of the ends of the rod. Mandrel 16 also is pivotally mounted at 17 to a shaft 18. The shaft 18 in turn is pivotally mounted at 19 to a link member 20 along a first end of the member 20. Link member 20 is supported by and rotates about a support 21 in a conventional manner. A second end of the member 20 is attached to and rotatably driven about the support 21 by an actuator 23 of a drive means 24.

Drive means 24 is mounted to a bracket 25 which is attached to the enclosure 40 of the plate bender 1 along any suitable support structure. The drive means 24 is conventional and may be a hydraulically, pneumatically or electrically activated device operated on command as later described in greater detail.

The mandrel 16, in the embodiment illustrated, is an elongated rectangular device having a plate engaging end 30 that acts as a sheer means for bending the edge 10 of the plate 7 downwardly, as referenced to FIG. 3, during movement of the support means 11 toward its upper most position. Mandrel 16 has a width dimension generally equal to the width dimension of the plate 7 being bent. As indicated, mandrel 16 has a longitudinal opening formed in it which receives the rod 45 in a conventional manner. Those skilled in the art will recognize that the rod 45 may be made integral with the mandrel 16, if desired. In any case, the rod 45 is positioned so that it aligns approximately with the first direction bend made in the plate 7.

After the edge 10 is bent by the mandrel 16, drive means 24 is energized so that the actuator 23 is driven from its first position, shown in FIGS. 3*a* and 3*b*, to an extended position, shown in FIG. 3*c*. Movement of the actuator 23 causes the link member 20 to rotate in a clockwise direction, clockwise being referenced to FIG. 3, so that the shaft 18 is pulled downwardly. Downward movement of the shaft 18 causes the mandrel 16 to rotate about the pivot 17 in a clockwise direction, forcing the end 30 of the mandrel 16 inwardly along a first contour 31 of the die 13, formed at an angle A with respect to a support surface 61 of the die 13. That movement simultaneously forces the end 10 of the plate 7 along a second contour 32 of the die 13, formed at an angle B with respect to a perpendicular surface 61, which bend is opposite in sense to the bend required to position the plate 7 against the contour 31. It thus may be observed that the reverse bend system 2 forms a dual bend along the end 10 of the plate 7 in a single motion of the drive means 24.

Figure 4:
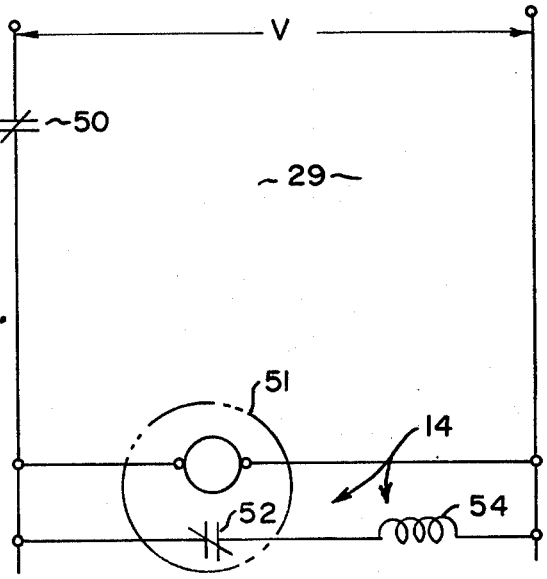
FIG. 4 is a diagrammatic view showing an electrical interconnection utilized in conjunction with the bender of FIG. 1 to produce a sequential plate bending operation.

In order to accomplish the various movements for the plate 7 formation safely, I have provided a timer circuit 29, diagrammatically illustrated in FIG. 4. In the conventional construction of the plate bender 1, the bender controls are arranged so that the drive means 14 automatically reverses after it has reached its full extension. Activation of the up cycle is controlled by a microswitch 50 which applies input voltage to the drive means 14, which, as indicated above, may be a solenoid 54 or similar device. In order to provide the time for second bend formation, I provide a timer 51 in parallel with the solenoid 54 which controls a switch 52 to hold the solenoid in its up position until the second bend is accomplished.

Figure 2:
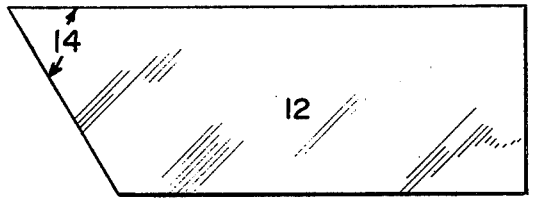
FIG. 2 is a view in side elevation of a die pair useful with the plate bender shown in FIG. 1.
Figure 2:
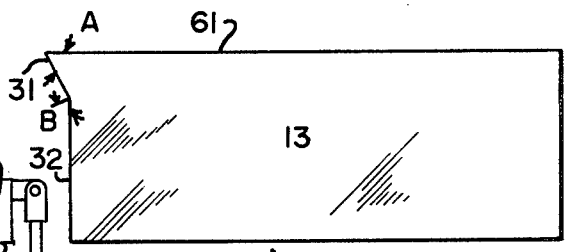

The construction of the dies 12 and 13 may vary with particular constructions of printing presses with which the plate bender 1 finds application. It is important that the angle A, shown in FIG. 2, corresponds to the angle of the groove in the press cylinder where the plate is to be inserted, so that the plate follows the contour of the cylinder accurately. The second bend provided by the mandrel 16 enables the plate to be maintained on the press cylinder without the necessity of finger grips or biasing means prevalent with prior art plate constructions. Consequently, the angle B may be varied to accomplish its cylinder attachment function.

Although the reverse bend system 2 is described in conjunction with the plate bender 1, those skilled in the art will appreciate that the reverse bend system 2, and its associated control mechanism shown in FIG. 4, may be incorporated as a conversion kit for older models of the bender 1. That is to say, the dies 12 and 13 and the various linkages, drive means 24 and mandrel 16 may be supplied as an independent kit for converting the prior art plate benders to devices capable of forming the plate described in the co-pending Signorelli et al application, Ser. No. 880,459, discussed above.

Numerous variations, within the scope of the appended claims, will be apparent to those skilled in the art in light of the foregoing description and accompanying drawings. Thus, the position or design silhouette of the various dies and mandrels may vary in other embodiments of this invention. Likewise, various drive means may be employed for those described and shown. While mandrel 16 operation was described as rotating, those skilled in the art will recognize that the second bend may be formed by devices which function linearly. In like manner, while the plate support 11 was described as reciprocating in a vertical direction, mandrel 16 may be designed so that the plate support remains stationary while the mandrel 16 is moved to form the required bends. The bend along the end 9 of the plate 8 may be accomplished with a variety of structures in place of the roller means described in conjunction with the preferred emboiment. In its broader context, the bend system 2 may assume a variety of possible structural configurations, there-by making the system 2 compatible with a number of commercially available plate benders, the bender 1 merely being illustrative of the variously available benders. These variations are merely illustrative.

Having thus described the invention, what is claimed and desired to be secured by Letters Patent is:

1. A plate bender, comprising:

support means for receiving a plate to be bent, said support means including end dies having contours the same as those desired for the ends of the plate after bending, each of said end dies having a first contour, and at least one of said dies having a second contour directed in an opposite sense to the first contour;

means for moving said support together with said plate thereon along a path between a first position and a second position including means for driving said support means upwardly from said first position to said second position;

means engageable with at least one end of said plate as said plate together with said support means moves along its path for forming a first bend in one end of said plate in one direction; and means actuable upon forming of said first bend for forming a second bend on said first contour and a third bend on said second contour in the one end of said plate, said third bend being made in an opposite sense to said second bend, said forming means including shear means rotatably supported relative to a respective end die of said support, and means for rotating said shear means relative to said end die so as to form said second and third bend, said last-mentioned means comprising an actuator and a linkage interconnecting said actuator and said shear means whereby actuation of said actuator causes rotation of said shear means so as to form said plate against said first and second contours to form said second and third bends in said plate, said shear means being supported adjacent the end of said respective end die for rotation about a generally horizontal axis.

2. The plate bender of claim 1 wherein said actuator is movable in generally linear direction, and wherein said linkage includes a rocker rotatably supported intermediate its ends and having one end thereof connected to said actuator so that upon movement of the actuator said rocker rocks on its support, said linkage further comprising a shaft interconnecting said rocker and said shear means so that upon actuation of said actuator, said shear means rotates about said horizontal axis.

3. In a plate bender including support means for receiving a plate to be bent, said support means including end dies having contours conforming to the desired contour for the ends of the plate after bending, each of said dies having a first contour, and at least one of said dies having a second contour directed in an opposite sense to the first contour, means for moving said support and plate along a path between a first position and a second position, and means engageable with at least one end of said plate as said support moves along its path for forming a first bend in one end of said plate, the improvement which comprises means actuable upon forming said first bend for forming a second bend on said first contour and a third bend on said second contour on the one end of said plate, said third bend being made in an opposite sense to said second bend, said forming means including shear means rotatably supported relative to a respective die of said support, and means for rotating said shear means relative to said end die so as to form said second and said third bends, said last-mentioned means including an actuator and a linkage interconnecting said actuator and said shear means whereby actuation of said actuator causes rotation of said shear means so as to engage said plate and to form said plate against said first and second contours.

4. The improvement of claim 3 wherein said shear means is supported adjacent the end of said respective end die for rotation about a generally horizontal axis.

5. The improvement of claim 4 wherein said actuator moves in a generally linear direction, said linkage including a rocker rotatably supported intermediate its ends and having one end thereof connected to said actuator so that actuator movement causes rocker movement, said linkage further comprising a shaft interconnecting said rocker and said shear means so that actuation of said actuator rotates said shear means about said horizontal axis.

* * * * *